US005592878A

United States Patent [19]

Eltner

[11] Patent Number: 5,592,878

[45] Date of Patent: Jan. 14, 1997

[54] CHAIN CONVEYOR OF A SHEET-FED PRINTING MACHINE

[75] Inventor: Bruno Eltner, Heidelberg, Germany

[73] Assignee: Heidelberger Druckmaschinen AG, Heidelberg

[21] Appl. No.: 507,065

[22] Filed: Jul. 26, 1995

Related U.S. Application Data

[63] Continuation of Ser. No. 157,723, Nov. 24, 1993, abandoned.

[30] Foreign Application Priority Data

Nov. 25, 1992 [DE] Germany ..... 42 39 561.5

[51] Int. Cl.[6] ..... B41F 5/02

[52] U.S. Cl. ..... 101/231; 101/229

[58] Field of Search ..... 101/231, 232, 101/229, 238–241; 271/200, 201, 197, 96

[56] References Cited

U.S. PATENT DOCUMENTS

| | | | |
|---|---|---|---|
| 4,083,556 | 4/1978 | Schilling et al. | 271/204 |
| 4,409,741 | 10/1983 | Bonomi | 34/162 |
| 4,479,645 | 10/1984 | Pollich | 271/183 |
| 4,572,071 | 2/1986 | Cappel et al. | 101/183 |
| 5,205,212 | 4/1993 | Demoore et al. | 101/420 |
| 5,263,415 | 11/1993 | Pollich | 101/232 |

FOREIGN PATENT DOCUMENTS

| | | |
|---|---|---|
| 3113750 | 10/1982 | Germany . |
| 2552998 | 11/1983 | Germany . |
| 3411029 | 10/1987 | Germany . |
| 257230 | 6/1988 | Germany . |
| 4030374 | 4/1992 | Germany . |
| 446462 | 4/1936 | United Kingdom . |
| 1075637 | 7/1967 | United Kingdom . |
| 1455856 | 11/1976 | United Kingdom . |

OTHER PUBLICATIONS

Bains, "Low force Sheet Feeder", Xerox Disclosure Journal vol. 4 No. 5 (Sep./Oct.)/1979, p. 631, 101/232.

*Primary Examiner*—Edgar S. Burr
*Assistant Examiner*—Anthony H. Nguyen
*Attorney, Agent, or Firm*—Herbert L. Lerner; Laurence A. Greenberg

[57] ABSTRACT

Chain conveyor of a sheet-fed printing machine for first-form and perfector printing includes guided revolving gripper chains, having a respective lower strand and a respective upper strand, at least a part of the lower strand being disposed in a sheet-conveying region, a sheet-guiding device disposed in the sheet-conveying region below the lower strand for guiding in a sheet-conveying direction a sheet having a downwardly directed printed side, the sheet-guiding device being formed with a guide surface continuously movable in the sheet-conveying direction at a sheet-conveying velocity parallel to the lower strand of the gripper chains, and a device for continuously driving the guide surface.

12 Claims, 3 Drawing Sheets

CHAIN CONVEYOR OF A SHEET-FED PRINTING MACHINE

This application is a continuation, of application Ser. No. 08/157,723, filed Nov. 24, 1993, now abandoned.

SPECIFICATION

The invention relates to a chain conveyor of a sheet-fed printing machine and, more particularly, to such a printing machine for first-form and perfector printing.

It has become known heretofore to transport printed paper sheets by means of revolving chain grippers over rigid guide surfaces from a last printing unit of a sheet-fed printing machine to a delivery region in order to deposit the sheets on a delivery pile. For this purpose, it has become known to form the rigid guide surfaces as a continuous guiding surface. A natural air cushion is generated between the rigid guide surfaces and conveyed paper sheets. Especially at high speeds, the paper sheets tend always to clap or slap against the rigid guide surface. At low speeds, large areas of the paper sheets virtually lie on the rigid guide surface and slide thereon. In both of the foregoing cases, rather excessive smearing of the lower printed paper sheets can result in the course of first-form and perfector printing, due to the relative speed between the paper sheet and the rigid guide surface. Such a delivery has, for example, become known heretofore from German Patent 25 52 998. For minimizing the smearing effects during first-form and perfector printing, it has also become known heretofore to provide rigid sheet-guiding surfaces with pass-through openings ending in suction boxes disposed below the rigid guide surface. The natural air cushion may thereby possibly be removed by suction with great control effort or expenditure, as a result of which, during the first-form and perfector printing process, fluttering of the sheets is possibly reducible with great control effort or expenditure. Especially at high speeds and large sheet formats or sizes, the problem of fluttering cannot be entirely eliminated. Smearing effects caused by the relative motion cannot be avoided completely. Such a rigid guide surface has become known heretofore from the published German Patent Document 34 11 029 C2, for example. For improving sheet transport, additional blowing-air sources are usually provided at critical locations above the sheet-guiding surface, and serve to press the paper sheet towards the rigid guide plates and towards the sucking rigid guide plates, respectively. In German Published Non-Prosecuted Patent Application (DE-OS) 31 13 750, a proposal is made for improving the sheet transport in some sections thereof by providing sheet guiding-yoke fans disposed upstream of the delivery pile and blowing opposite to the sheet-conveying direction. In this case, too, a reduction in the fluttering at high printing speeds is possible only with great control effort or expenditure.

The aforedescribed conventional constructions cause smearing if the sheet surface comes into contact with the sheet-guiding surface due to the relative speeds therebetween. From German Patent 25 52 998, it has become known heretofore to form the sheet-guiding surface of successively arranged guide wheels. The guide wheels are turned by the paper sheets lying thereon and sliding thereover. Sliding motions between guide wheels and driving paper sheets are thereby possible, due to which smearing may result.

With so-called sorters for distributing and assigning or allocating paper sheets into individual bins or pigeon holes, suction-tape conveyors are provided which convey the paper sheets to the delivery locations. In this regard, the entire unprinted sheet sides, respectively, of the paper sheets lies on the suction tape and are pressed with great suction force onto the tape by means of the suction air from below the suction tape so that the sheets are transported solely by the suction tape. With such a device, however, the printing quality of freshly printed and not yet sufficiently dried undersides of sheets being printed in a first-form and perfector printing process would be considerably impaired due to the pressing contact between suction tape and paper sheets resulting from the suction force required for the transport, which causes the respective freshly-printed undersides of the sheets to be imprinted or reproduced, in turn, on the suction tape. Even at high printing speeds, a precise transport of paper sheets which have been printed on both sides thereof requires a transport system ensuring a sheet transport precisely defined with respect to the printing-machine angle and without any danger of the paper sheets slipping or sliding with respect to the printing-machine angle. Such a smooth suction-tape transport, as is conventional with sorters, would require the application of very great suction pressure, especially at high speeds and when processing large sheet formats, in order to assure a fairly satisfactory and precise sheet transport.

It is accordingly an object of the invention to provide a chain conveyor of a sheet-fed printing machine for effecting an exact and reliable transport of paper sheets printed on both sides in the sheet-fed printing machine by a first-form and perfector printing process at high printing speeds, which ensures a reliable and smear-free sheet transport.

With the foregoing and other objects in view, there is provided, in accordance with the invention, a chain conveyor of a sheet-fed printing machine for first-form and perfector printing, comprising guided revolving gripper chains, having a respective lower strand and a respective upper strand, at least a part of the lower strand being disposed in a sheet-conveying region, a sheet-guiding device disposed in the sheet-conveying region below the lower strand for guiding in a sheet-conveying direction a sheet having a downwardly directed printed side, the sheet-guiding device being formed with a guide surface continuously movable in the sheet-conveying direction at a sheet-conveying velocity parallel to the lower strand of the gripper chains, and means for continuously driving the guide surface.

The chain conveyors permit an exact sheet transport through the conveying region. The sheet-guiding surface continuously driven in the sheet-conveying direction parallel to the lower strand of the gripper chains prevents the occurrence of relative speeds between the paper sheet and the sheet-guiding surface in the sheet-conveying direction, when a respective underside of a paper sheet comes into contact with the sheet-guiding surface. A result thereof is that smearing effects can be minimized considerably. Additional complicated controlling or regulation is able to be markedly reduced. The natural air cushion between paper sheet and sheet-guiding surface has a slightly favorable effect upon the drying behavior of the printed undersides of the respective sheets during the sheet transport.

In accordance with another feature of the invention, the continuously movable guide surface is formed on revolvingly guided flexible tape material.

In accordance with a further feature of the invention, the revolvingly guided tape material whereon the continuously movable guide surface is formed has a tape width extending over a maximum width of the sheet being conveyed.

In accordance with an added feature of the invention, the continuously movable guide surface is formed on an upper strand of a plurality of guided revolving tapes having perforations formed therein, the tapes being uniformly distributed over the sheet width, and a table plate is provided over which the upper strand is guided, the table plate being formed with uniformly distributed pass-through openings below the tapes.

In accordance with an additional feature of the invention, the continuously movable guide surface is formed with uniformly distributed pass-through openings extending from a sheet-guiding surface thereof to below the guide surface, and suction means are included which are disposed below the guide surface and are directed upwardly in a vicinity of a trailing edge of the sheet.

According to the foregoing last two features of the invention, a reliable holding contact is provided with the moved guide surface due to the suction action effective through the suction surface. The trailing sheet edge can thus be prevented from being lifted from the sheet-guiding surface. In addition to reducing smearing effects, the natural air cushion, because of the absence of relative speeds, avoids clapping or slapping effects due to lifting of the respective trailing sheet edge. The tape extending across the sheet width permits a uniformly distributed holding contact over the entire sheet width.

In accordance with yet another feature of the invention, the continuously movable guide surface is formed with uniformly distributed pass-through openings extending downwardly to below the guide surface, and a plurality of controllable suction boxes are included which are arranged in succession below the guide surface and in the sheet-conveying direction.

The foregoing construction permits an individually adjustable application of suction in the sheet-conveying direction. In this regard, it is possible to permit only the suction boxes assigned to the trailing sheet edge to be activated. Furthermore, it is possible to control the suction boxes so that, in addition to holding the trailing sheet edge, the natural air cushion is also reduced in a region forward of the trailing sheet edge in accordance with the respective individual requirements. This may be accomplished by uniformly applying an air cushion over the entire sheet-transport region without requiring complicated controlling efforts. In the vicinity of the trailing sheet edge, the suction force holds the sheet on the guide surface. A reduced air cushion is applied in a forward region of the respective sheet.

In accordance with yet a further feature of the invention, the chain conveyer includes a respective fan for each of the controllable suction boxes for providing a uniform negative pressure in the respective suction box with a low level and a small drop in pressure on the inlet side even at great differences of sheet-conveying speed. The uniform negative pressure in the suction box, with a lower level on the inlet side, permits a uniform sucking of the trailing sheet edge onto the sheet-guiding surface in the vicinity of each suction box. The slight drop in pressure over high speed ranges of the sheet transport permits a reliable transport both at low and at very high printing speeds.

In accordance with yet an added feature of the invention, the continuously movable guide surface is formed with uniformly distributed pass-through openings extending downwardly to below the guide surface, and further included are a common suction box extending over the sheet-conveying region and a maximum sheet width, and a fan disposed in the suction box for providing a uniform negative pressure on a low level on the inlet side of the suction box and a slight drop in pressure over a great range of differences in the sheet-conveying speed. In this regard, it is possible to apply a uniform holding force over the entire, transport region.

In accordance with yet an additional feature of the invention, the revolving flexible tape is formed of heat-resistant textile or plastic material. This feature ensures an exact sheet transport with a reliable conveyance of sheets also in the vicinity of thermal drying devices provided in the deliveries of sheet-fed printing machines, without requiring additional efforts or expense.

In accordance with again another feature of the invention, the guide surface has an adjustable length in the sheet-conveying direction. This feature ensures a simple and reliable sheet transport, adapted to the respective sheet format, up to the delivery area.

In accordance with again a further feature of the invention, the chain conveyor includes a plurality of deflecting elements about which the tape material is guided so as to form an upper and a lower strand thereon, a rear one of the deflecting elements, as viewed in the sheet-conveying direction, being disposed upstream of the delivery pile and being adjustable in position in the sheet-conveying direction in accordance with a format of the sheet, means for changing the position of the rear one of the deflecting elements, and a tape-storing unit disposed in a vicinity of the lower strand of the tape material. This feature thus provides for a simple sheet-format adjustment.

In accordance with a concomitant feature of the invention, the chain conveyor includes sheet-braking rollers disposed upstream of the delivery pile, the rear one of the deflecting elements being formed as at least one deflecting roller mounted co-axially with the sheet-braking rollers and being adjustable in position thereof, together with the sheet-braking rollers, in accordance with a sheet format variation. This feature provides a simple sheet transport up to the delivery pile, independently of the respective sheet size or format, by simply integrating the conventionally available suction rollers for braking or decelerating the paper sheets and the available position-adjusting devices thereof.

Other features which are considered as characteristic for the invention are set forth in the appended claims.

Although the invention is illustrated and described herein as embodied in a chain conveyor of a sheet-fed printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
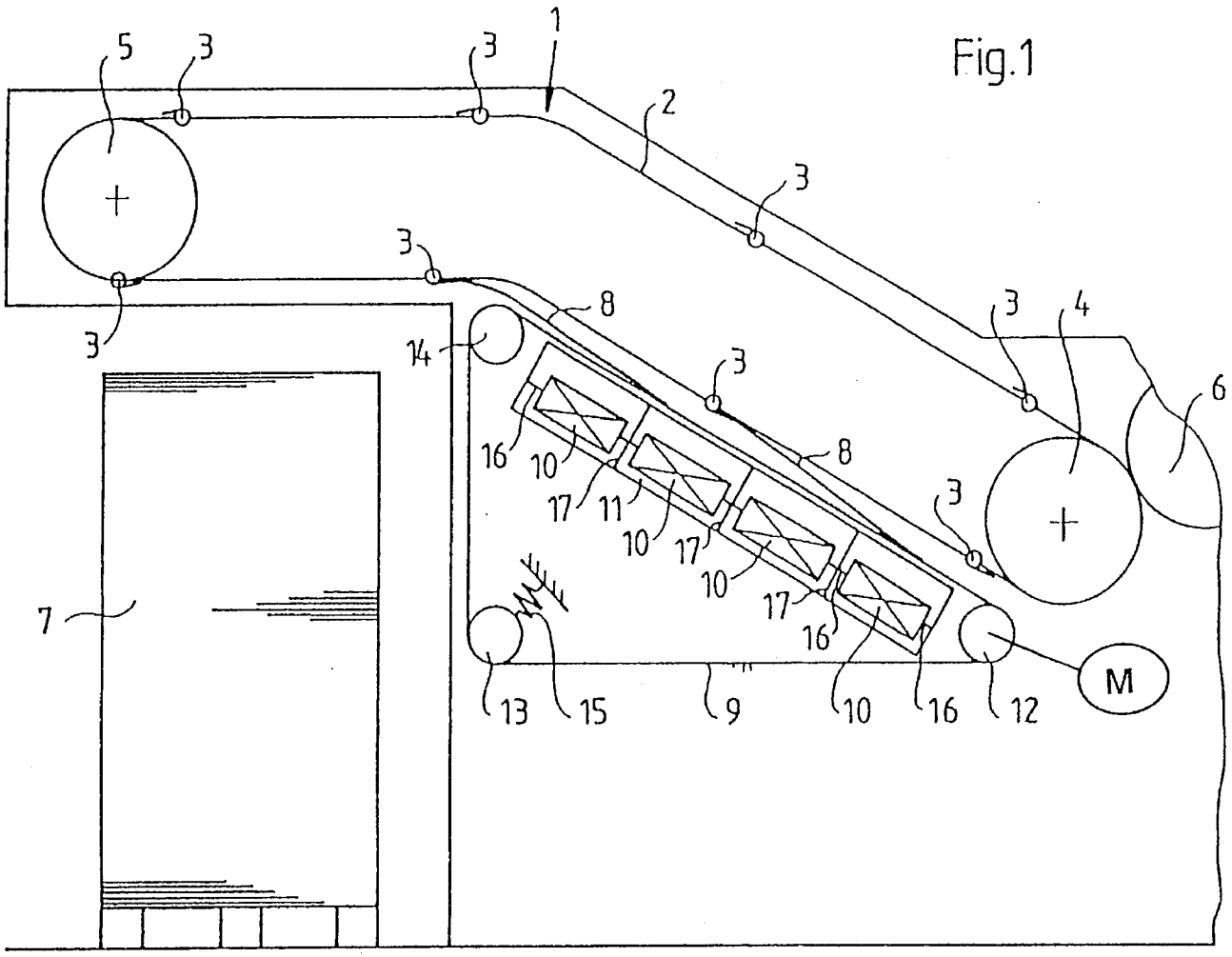
FIG. 1 is a diagrammatic side elevational view of an embodiment of the chain conveyor according to the invention in a delivery region of a sheet-fed printing machine;.

Referring now to the drawings and, first, particularly to FIG. 1 thereof, there is shown therein a chain conveyor system 1 of a delivery of a sheet-fed printing machine wherein, in a conventional manner, paper sheets 8 are taken-over, from an impression cylinder 6 of an otherwise non-illustrated last printing unit, by gripper bars 3 attached to gripper chains 2 which revolve on continuously driven sprocket wheels 4 and 5 which, in turn, are rotatably mounted on or journalled in the side walls of the printing machine. Below the lower strand of the gripper chains 2, the paper sheets 8 are then transported to a delivery pile 7 where the paper sheets 8, after having been braked or slowed down by a conventional non-illustrated braking device, are deposited on the delivery pile 7 by opening the grippers on the gripper bars 3. During the travel of the paper sheets 8 between the reversing sprocket wheel 4 and the delivery pile 7, a trailing area of the respective undersides of the paper sheets 8 lies on a blanket or cloth 9 which is wound around deviating or deflecting guide rollers 12, 13 and 14. In a conventional manner, the deviating rollers 12, 13 and 14 are rotatably mounted on or journalled in the machine side frames. Moreover, the deviating roller 13 is mounted so as to be displaceable in order to apply tension to the cloth or blanket 9. By means of a compression spring 15 supported by the side walls and directed in the direction of displacement of the deviating roller 13, the latter is pressed from within against the cloth or blanket 9. The deviating roller 12 is controllably driven in a conventional manner. The cloth or blanket 9 is guided around a suction box 11 which extends between the deviating rollers 12 and 14, i.e., from the one roller 12 to the other roller 14, and over a maximum paper-sheet width and over the conveyance range or distance between the two rollers 12 and 14. A plurality of controllable fans 10, four in number in the embodiment of FIG. 1, are disposed in succession and mutually adjacent in the suction box 11.

The cloth or blanket 9 is a porous tape formed formed of textile or plastic material and extending over at least the maximum sheet width. In the conveying range of the cloth 9, the fans 10 suck the paper sheets 8, at the respective trailing edge thereof, onto the cloth 9 where they are retained. Due to the fact that the gripper bar 3 and the upper strand of the cloth 9 running spaced from and parallel to the lower strand of the gripper chains 2 travel at the same speed, the paper sheets 8 are guided over the conveying range at a mutually spaced-apart distance by the respective leading sheet edge and the respective trailing sheet edge thereof. The natural air cushion between the sheet 8 and the cloth 9 is partly reduced by means of the suckers so that the trailing edge of the sheet 8 is prevented even more reliably from tearing away from the cloth 9. It is conceivable that the individual controlling of the fans 10 can be so adjusted that, over a wide region of the paper sheet 8, the natural air cushion prevents any contact between the paper sheet 8 and the cloth 9.

Moreover, it is conceivable to provide partitions 17 between the individual fans for an exact regulation of the air cushion so that the air cushion can be precisely adjusted. It is also conceivable that the partitions 17 be disposed so as to extend perpendicularly to the plane of the drawing of FIG. 1, thereby forming uniformly sucking suction boxes which extend in the direction of the sheet width and are successively disposed in sheet-conveying direction. In the embodiment of the invention represented in FIG. 3, suction boxes 29 extending at least over the maximum sheet width are provided behind one another in the sheet-conveying direction, an axial-flow fan 30 being attached below each of the suction boxes 29. The great air-flow rate of the axial-flow fans 30 and the non-illustrated characteristic curve thereof which gently slopes with increasing sheet-conveying velocity and which permits a uniform pressure distribution at the suction area directed upwardly in the suction box ensure a reliable sheet transport both at very high and very low speeds.

Figure 2:
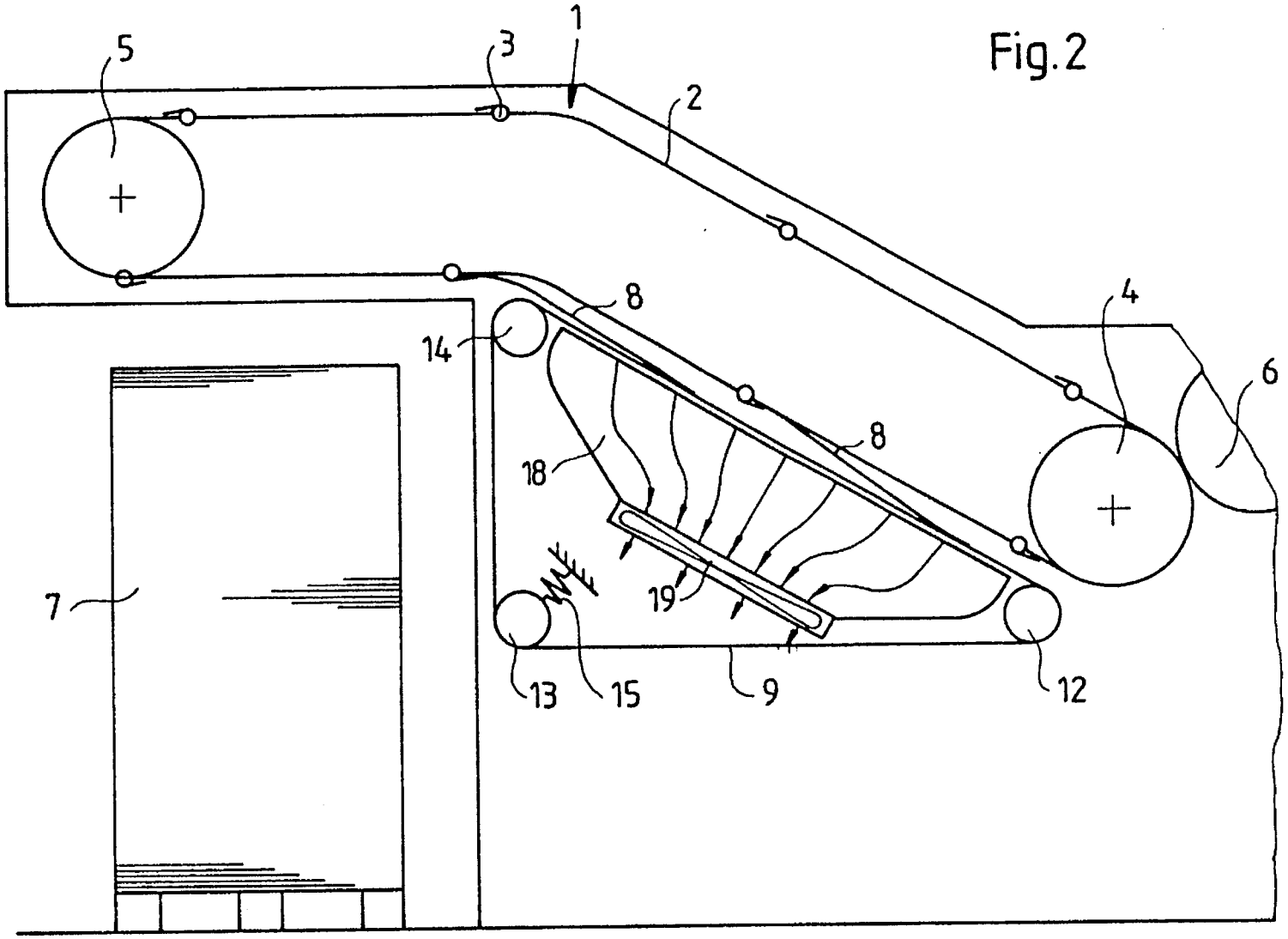
FIG. 2 is a view like that of FIG. 1 of another embodiment of the chain conveyor having a common suction box.

FIG. 2 shows an embodiment wherein, in the conveying range between the deviating rollers 12 and 14, a common suction box 18 extending over at least the maximum sheet width, as viewed into the plane of the drawing, is fastened to the machine frame below the upper strand of the cloth 9, and a single axial-flow fan 19 is attached to the suction box 18 therebelow. In this embodiment of the invention, as well, for low speed-dependent differences in pressure, the high air-flow rate permits the trailing edge of the sheet 8 to be held reliably over a high speed range. If a drying region with thermal dryers is provided in the conveying range of the cloth 9, it is sensible to use a cloth 9 formed of heat-resistant material.

Instead of the cloth 9 it is also conceivable to use revolving suction tapes which are distributed over the maximum sheet width and are guided over a table plate 33 (FIG. 3) covering one or more suction boxes which are provided underneath the table plate. Below the suction tapes, the table plate 33 is provided with uniformly distributed openings 34 leading into the suction boxes. Of course, such a perforated table plate 33 disposed between a moving guide surface and stationary suction boxes may also be realized in embodiments provided with the cloth 9.

Figure 3:
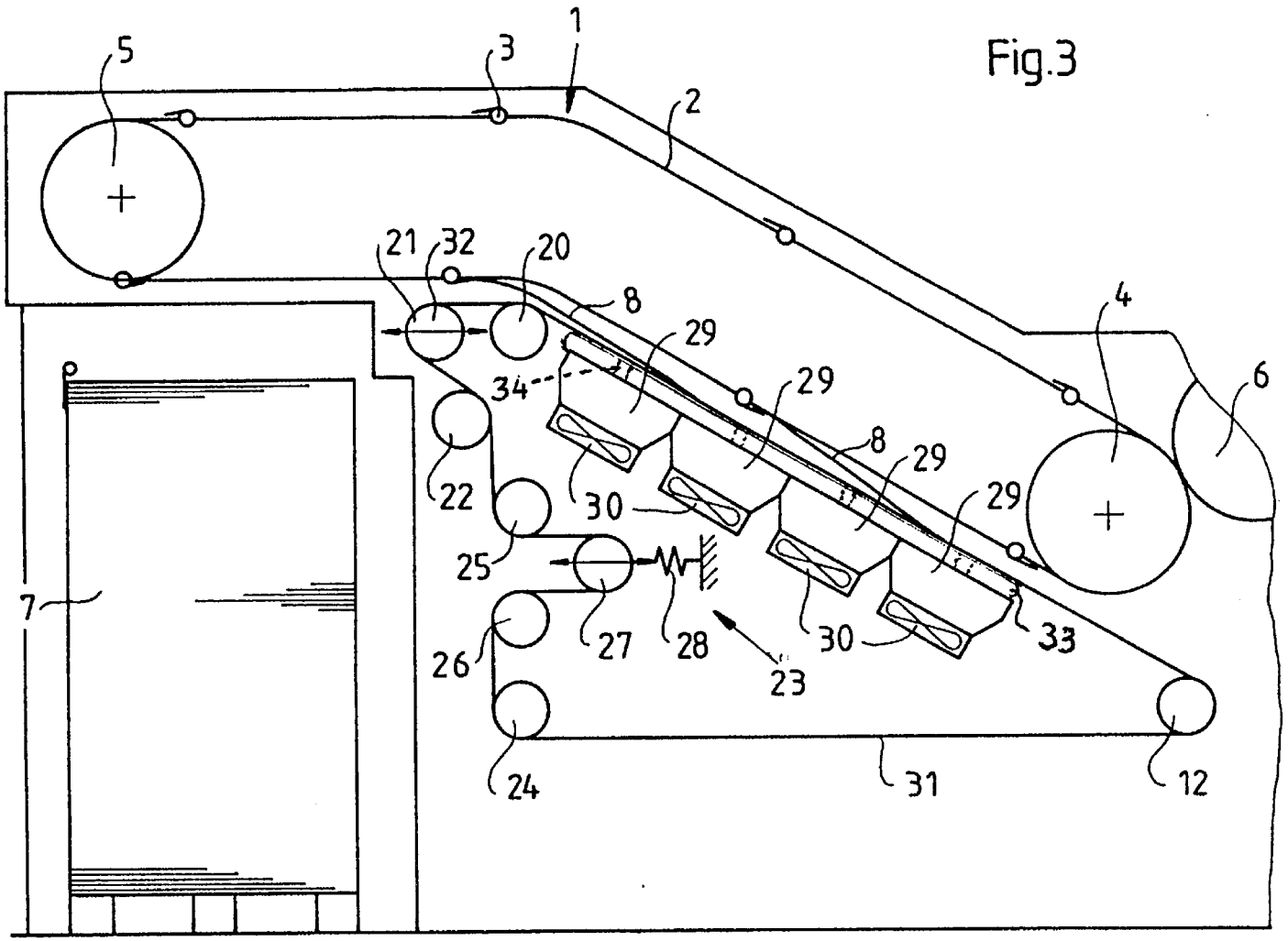
FIG. 3 is another view like those of FIGS. 1 and 2 of a third embodiment of the chain conveyor, which is provided with sheet-guiding surfaces adjustable to the sheet size or format.

In the embodiment of the invention shown in FIG. 3, a suction cloth or suction tapes 31 are guided around deviating or deflecting rollers 12, 20 and 24 and around a deflecting roller 32. A portion of the flexible material 31 between the rollers 12 and 32 defined the guide surface for the sheets. The position of which, in a conventional manner, is variable and adjustable in the sheet-conveying direction in order to adapt the format or size of the oncoming sheets 8 to that of the sheet delivery, and are passed through a cloth or tape-storing unit 23. The cloth or tape-storing unit 23, for example, includes deviating rollers 25 and 26 and a deflecting or reversing roller 27 which is displaceably mounted on the machine side frames. Via a spring 28 braced against the side frames, the deflecting or reversing roller 27 is maintained in constant tensioning contact with the suction cloth or suction tapes 31. The paper sheets 8 are transported by the chain grippers of the gripper bar 3 along the suction boxes 29 or, as shown in the embodiments of FIGS. 1 and 2, along the suction box 11 or 18, with the trailing sheet edge being kept on the cloth or tapes 31. Thereafter, the speed of the trailing sheet edge is slowed down by the sheet-braking device disposed downstream from or at the deflecting pulley 32, as viewed in the sheet-conveying direction, and the respective sheet 8 is slowly deposited on the delivery pile 7, the sheet-braking device being adjustable in a conventional manner with respect to the position thereof in order to adapt the sheet format or size to the sheet delivery after the gripper bars 3 have released the leading edge of the respective sheet 8. With smaller sheet formats, the braking or slow-down device and the deflecting roller 32 are displaced in the sheet-conveying direction. The additional cloth or tape material which is consequently required is provided by the tape or cloth-storing unit 23. When the sheet size or format is increased in length, the braking or slow-down device and the deflecting roller 32 are displaced in a direction opposite to the sheet-conveying direction, and the tape or cloth-storing unit 23 thereby stores the excess cloth or tape material.

When the embodiment of the invention uses the suction tapes, it is conceivable to construct the deflecting roller 32 as a guide roller rotatably mounted co-axially with decelerating suction rollers 21 of the aforementioned braking or slow-down unit. In a conventional manner, the decelerating suction rollers 21 are connected to a non-illustrated controllable drive and a controllable suction-air supply.

The aforementioned suction openings or perforations 34 formed in the table plate 33 and/or in the suction tapes may be of diverse form in accordance with respective individual requirements. They may, for example, be quite round or slotshaped with a longitudinal axis extending in the sheet-conveying direction or in the direction of the sheet width. The perforations or openings 34 may be distributed uniformly over the surface of the table plate 33 or may be arranged in mutually adjacent parallel rows in the sheet-conveying direction, the rows of openings being disposed so that the openings thereof are disposed in a line extending transversely to the sheet-conveying direction or are partly offset from one another.

At the respective underside of the suction tapes, the latter may be formed with a guide profile extending transversely to the sheet-conveying direction and corresponding or matching with a guide groove formed in the table plate and also extending in the sheet-conveying direction, thereby ensuring an exact guidance of the suction tapes.

The size of the perforations or openings formed in the table plate may be selected so that they are much larger than the perforations in the suction tape. In order to tauten or apply tension to the trailing edge of the respective sheet 8, it is conceivable, in accordance with the invention, to form the suction tapes so that they are slightly diverging in the sheet-conveying direction.

I claim:

1. Chain conveyor of a sheet-fed printing machine for first-form and perfector printing, in which sheets are guided in a sheet conveying direction, comprising guided revolving gripper chains, having a respective lower strand and a respective upper strand, at least a part of said lower strand being disposed in a sheet-conveying region, a sheet-guiding device disposed in said sheet-conveying region below said lower strand for guiding in a sheet-conveying direction a sheet having a downwardly directed printed side, said sheet-guiding device being formed with a plurality of deflecting rollers and a flexible material guided about said deflecting rollers, a portion of said flexible material between two deflecting rollers parallel to said lower strand of said gripper chains defining a guide surface continuously movable in said sheet-conveying direction at a sheet conveying velocity means for continuously driving said guide surface, and one of said deflecting rollers being displaceable for varying the length of said continuously movable guide surface in said sheet conveying direction.

2. Chain conveyor according to claim 1, wherein said flexible material is revolvingly guided flexible tape material, said continuously movable guide surface being formed on said revolvingly guided flexible tape material.

3. Chain conveyor according to claim 2, wherein said revolvingly guided flexible tape material whereon said continuously movable guide surface is formed has a tape width extending over a maximum width of the sheet being conveyed.

4. Chain conveyor according to claim 1, wherein said continuously movable guide surface is formed on an upper strand of a plurality of guided revolving tapes having perforations formed therein, said tapes being uniformly distributed over the sheet width, and including a table plate over which said upper strand is guided, said table plate being formed with uniformly distributed pass-through openings below said tapes.

5. Chain conveyor according to claim 1, wherein said continuously movable guide surface is formed with uniformly distributed pass-through openings extending from a sheet-guiding surface thereof to below said guide surface, and including suction means disposed below said guide surface and being directed upwardly in a vicinity of a trailing edge of the sheet.

6. Chain conveyor according to claim 1, wherein said continuously movable guide surface is formed with uniformly distributed pass-through openings extending downwardly to below said guide surface, and including a plurality of controllable suction boxes arranged in succession below said guide surface and in said sheet-conveying direction.

7. Chain conveyor according to claim 6, including a respective fan for each of said controllable suction boxes for providing a uniform negative pressure in the respective suction box with a low level and a small drop in pressure on the inlet side even at great differences of sheet-conveying speed.

8. Chain conveyor according to claim 1, wherein said continuously movable guide surface is formed with uniformly distributed pass-through openings extending downwardly to below said guide surface, and including a common suction box extending over said sheet-conveying region and a maximum sheet width, and a fan disposed in said suction box for providing a uniform negative pressure on a low level on the inlet side of the suction box and a slight drop in pressure over a great range of differences in the sheet-conveying speed.

9. Chain conveyor according to claim 2, wherein said revolving flexible tape is formed of heat-resistant textile or plastic material.

10. Chain conveyor according to claim 1, wherein said guide surface has an adjustable length in said sheet-conveying direction.

11. Chain conveyor according to claim 2, including a plurality of deflecting elements about which said tape material is guided so as to form an upper and a lower strand thereon, a rear one of said deflecting elements, as viewed in said sheet-conveying direction, being disposed upstream of the delivery pile and being adjustable in position in said sheet-conveying direction in accordance with a format of the sheet, means for changing the position of said rear one of said deflecting elements, and a tape-storing unit disposed in a vicinity of said lower strand of said tape material.

12. Chain conveyor of a sheet-fed printing machine for first-form and perfector printing in which sheets are guided in a sheet-conveying direction, comprising guided revolving gripper chains, having a respective lower strand and a respective upper strand, at least a part of said lower strand being disposed in a sheet-conveying region, a sheet-guiding device disposed in said sheet-conveying region below said lower strand for guiding in a sheet-conveying direction a sheet having a downwardly directed printed side, said sheet-guiding device being formed with a guide surface continuously movable in said sheet-conveying direction at a sheet-conveying velocity parallel to said lower strand of said gripper chains, means for continuously driving said guide surface, said continuously movable guide surface being formed with uniformly distributed pass-through openings extending from a sheet-guiding surface thereof to below said guide surface, and suction means disposed below said guide surface and being directed upwardly in a vicinity of a trailing edge of the sheet.

* * * * *